US006663207B2

(12) United States Patent
Su et al.

(10) Patent No.: US 6,663,207 B2
(45) Date of Patent: Dec. 16, 2003

(54) DETERMINING INKJET PRINTER PEN TURN-ON VOLTAGES

(75) Inventors: Wen-Li Su, Vancouver, WA (US); Christopher A Schantz, Redwood City, CA (US); Jesse Fisher, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/215,970

(22) Filed: Aug. 9, 2002

(65) Prior Publication Data

US 2003/0043222 A1 Mar. 6, 2003

Related U.S. Application Data

(63) Continuation of application No. 09/940,313, filed on Aug. 27, 2001, now Pat. No. 6,454,376.

(51) Int. Cl.[7] ..... B41J 2/07
(52) U.S. Cl. ..... 347/9; 347/19
(58) Field of Search ..... 347/9, 10, 14, 347/19

(56) References Cited

U.S. PATENT DOCUMENTS

| | | | | |
|---|---|---|---|---|
| 5,726,690 A | * | 3/1998 | Bohorquez et al. | 347/19 |
| 5,751,302 A | * | 5/1998 | Rezanka | 347/9 |
| 5,821,953 A | | 10/1998 | Nakano et al. | |
| 6,086,190 A | * | 7/2000 | Schantz et al. | 347/19 |
| 6,270,179 B1 | | 8/2001 | Nou | |

FOREIGN PATENT DOCUMENTS

| | | |
|---|---|---|
| EP | 0899102 | 3/1999 |
| EP | 1085655 | 3/2001 |

OTHER PUBLICATIONS

British Patent Office Search Report dated Sep. 4, 2002.

* cited by examiner

*Primary Examiner*—Stephen D. Meier
*Assistant Examiner*—Julian D. Huffman

(57) ABSTRACT

Determining inkjet printer pen turn-on voltages is disclosed. An inkjet printer has a number of pens, and a number of sets of nozzles in each pen. Each set of nozzles of a pen is fired at each of a number of voltages, to obtain a voltage-value curve for each set of nozzles. A nozzle turn-on voltage for each set of nozzles is determined based on a maximum slope of its voltage-value curve. The turn-on voltage for each pen is determined based on the nozzle turn-on voltages of the voltage-value curves for its sets of nozzles.

19 Claims, 6 Drawing Sheets

DETERMINING INKJET PRINTER PEN TURN-ON VOLTAGES

This is a continuation of application Ser. No. 09/940,313 filed on Aug. 27, 2001 now U.S. Pat. No. 6,454,376, which is hereby incorporated by reference herein.

FIELD OF THE INVENTION

This invention relates generally to pens for inkjet printers, and more specifically to determining the turn-on voltage for such pens.

BACKGROUND OF THE INVENTION

Inkjet printers have become increasingly inexpensive and increasingly popular, especially for home computer users. A typical inkjet printer usually has a number of common components, regardless of its brand, speed, and so on. There is usually a print head that contains a number of pens, where each pen has a series of nozzles used to spray drops of ink onto paper. Alternatively, the pens may be separate, and not located on a common print head. Ink cartridges, either integrated into the print head or separate therefrom, supply the ink. There may be separate black and color cartridges, color and black in a single cartridge, a cartridge for each ink color, or a combination of different colored inks in a given cartridge.

A print head motor typically moves the print head assembly back and forth horizontally, or laterally, across the paper, where a belt or cable is used to attach the assembly to the motor. Other types of printer technologies use either a drum that spins the paper around, or mechanisms that move the paper rather than the print head. The result is the same, in that the print head is effectively swept across the paper linearly to deposit ink on the paper. Rollers pull paper from a tray, feeder, or the user's manual input, and advance the paper to new vertical locations on the paper.

For the pens to fire their nozzles, resulting in ink sprayed on the paper inserted in the printer, a turn-on voltage is applied. The turn-on voltage causes the nozzles to fire. The turn-on voltage for each pen is desirably precisely known, so that only the exact turn-on voltage is applied to fire the nozzles of a pen. If a greater voltage is applied, the voltage in excess of the turn-on voltage is typically converted into heat. The ink may therefore increase in temperature beyond its recommended setting, which may cause printing quality to decrease. For example, too much ink may be deposited on the paper, or printing artifacts may otherwise be deposited on the paper. Furthermore, excess voltage may result in greater wear-and-tear on the pens and their nozzles, causing them to fail prematurely.

Although the inkjet printer pens in theory have a common specified turn-on voltage, in actuality the turn-on voltage for each pen varies depending on a number of different factors. Manufacturing tolerances may cause the turn-on voltages for different pens, as well as for different nozzles within the same pen, to vary. Other voltage errors may result from variations within the inkjet printer itself. For example, the traces and other electrical connections and components within the printer may have electrical resistances less than or greater than specified amounts, such that voltage drops across these connections and components may be less than or greater than what is expected. This means that the actual voltage applied to the inkjet printer pens to turn them on may vary from nozzle to nozzle, from pen to pen, and from printer to printer, effectively causing the turn-on voltages of the pens to vary.

These variations mean that using a common theoretical specified turn-on voltage for each pen in each printer will likely cause a decrease in printing quality and result in printing artifacts to develop on the media printed on by the printers. Even determining the turn-on voltages for the pens in isolation, without considering the specific printer in which they are being used, may cause such printing quality degradation. For these and other reasons, therefore, there is a need for the present invention.

SUMMARY OF THE INVENTION

The invention relates to determining the turn-on voltage for inkjet printer pens. An inkjet printer has a number of pens, and a number of sets of nozzles in each pen. Each set of nozzles of a pen is fired at each of a number of voltages, to obtain a voltage-value curve for each set of nozzles. A nozzle turn-on voltage for each set of nozzles is determined based on a maximum slope of its voltage-value curve. The turn-on voltage for each pen is determined based on the nozzle turn-on voltages of the voltage-value curves for its sets of nozzles.

Still other aspects, embodiments, and advantages of the invention will become apparent by reading the detailed description that follows, and by referring to the accompanying drawings.

DETAILED DESCRIPTION OF THE INVENTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Representative Inkjet Printer

Figure 1:
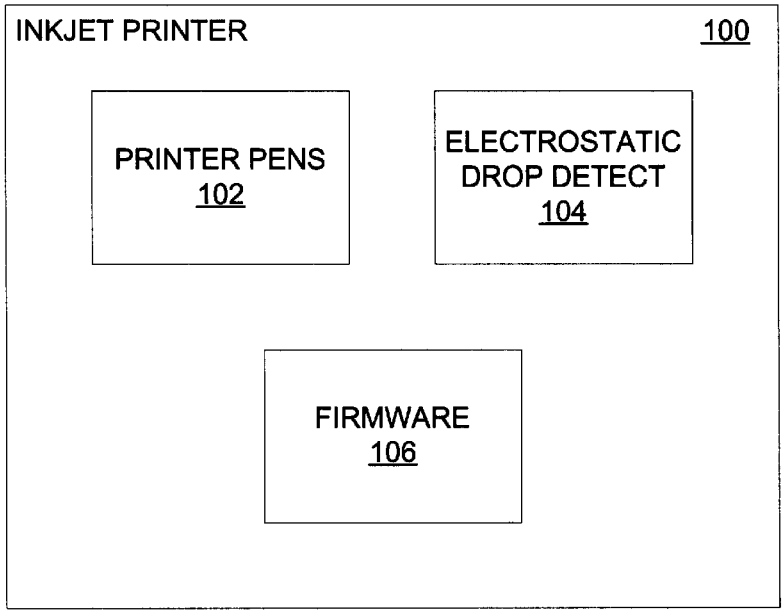
FIG. 1 is a block diagram of a representative inkjet printer according to an embodiment of the invention, in which only those components of the printer specified by the embodiment are shown.

FIG. 1 is a block diagram of a representative inkjet printer 100 according to an embodiment of the invention. Only those components specified by the embodiment of the invention are depicted in FIG. 1. Those of ordinary skill within the art will appreciate that other components are typically present in inkjet printers, such as rollers, print heads, and so on, and such components can be included in printers according to embodiments of the invention. The printer 100 includes printer pens 102, an electrostatic drop detect 104, and firmware 106. The printer pens 102 generally include a pen for each of a number of differently colored ink, as well as one or more pens for black ink. For example, there may be four pens, one for cyan ink, one for magenta ink, one for yellow ink, and one for black ink. The printer pens 102 have nozzles that spray the ink. For purposes of determining the turn-on voltages for the pens 102, these nozzles are aimed at the electrostatic drop detect 104.

The electrostatic drop detect 104 is one type of drop detect. The electrostatic drop detect 104 detects the charge of the ink drop that is induced upon it by the electrostatic drop detect. This amount of charge that is detected is related to the amount of ink that is deposited on the drop detect and is represented by an electrostatic drop detect score. In this way, the drop detect 104 can be used to determine the amount of ink that has been sprayed by the nozzles of one of the pens 102. The drop detect 104 may be that which is described in U.S. Pat. No. 6,086,190.

The firmware 106 is a computer-readable medium, such as a non-volatile memory or another type of memory, that stores instructions that can be executed by a processor of the printer 100 (not specifically shown in FIG. 1) to cause the printer 100 to operate. In the embodiment of the invention of FIG. 1, the firmware 106 includes instructions to determine the turn-on voltages of the pens 102, such that the firmware 106 subsequently uses these voltages when operating the printer 100. The firmware 106 may also include instructions as to how often the turn-on voltage of the pens 102 are determined, such as when new pens 102 and/or new ink cartridges are installed, and periodically over the operating life of the pens 102.

Figure 2:
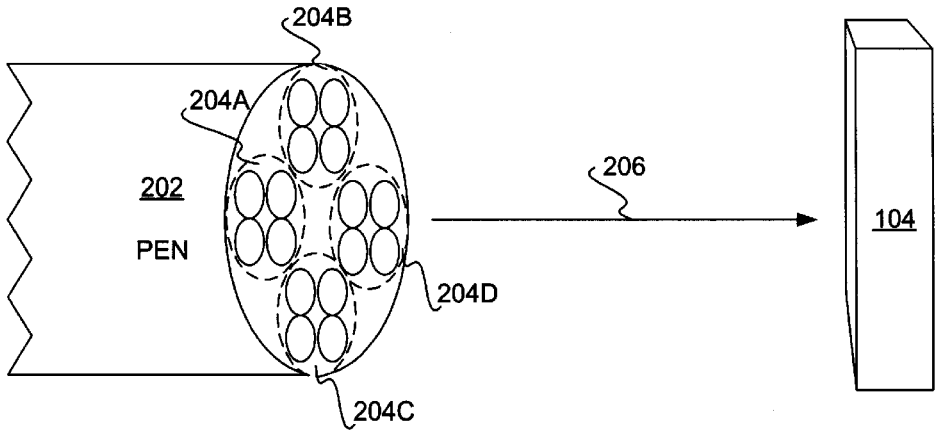
FIG. 2 is a diagram of a representative inkjet printer pen and its constituent nozzles aimed at a drop detect, according to an embodiment of the invention.

FIG. 2 shows the nozzles of an inkjet printer pen 202, which can be one of the printer pens 102 of FIG. 1, firing on a drop detect, such as the electrostatic drop detect 104 of FIG. 1, in more detail. An inkjet pen 202 has a number of nozzles divided into sets of nozzles 204A, 204B, 204C, and 204D. The nozzles are aimed at drop detect 104, as indicated by the arrow 206. As used in embodiments of the invention, each set of nozzles 204A, 204B, 204C, and 204D is individually fired at the drop detect 104. The number of nozzles shown in FIG. 2 is greatly reduced for illustrative clarity. Typically, there may be more than 200 such nozzles in a given inkjet printer pen. Furthermore, there may be fewer or greater number of sets of nozzles than the four sets that are specifically shown in FIG. 2.

Determining Turn-On Voltages for Inkjet Printer Pens

Figure 3:
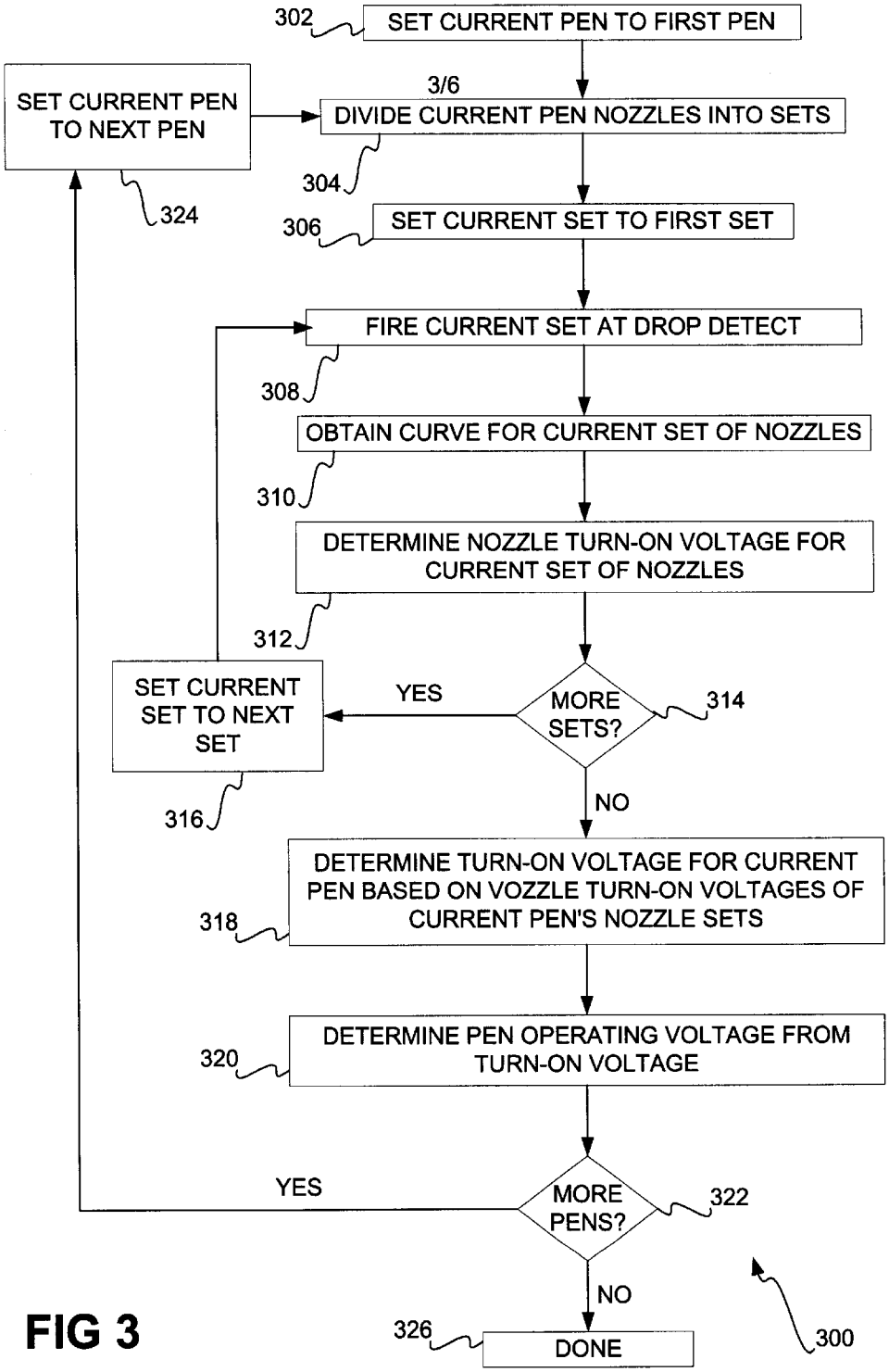
FIG. 3 is a flowchart of a method showing generally how one embodiment of the invention determines the turn-on voltages for the pens of an inkjet printer.

FIG. 3 shows a general method 300 performed by an embodiment of the invention to determine the turn-on voltages for inkjet printer pens, such as those shown in and that have described in conjunction with FIGS. 1 and 2. The method 300 may be performed by the firmware of an inkjet printer, such as the firmware 106 of the printer 100 of FIG. 1. The method 300 also may more generally be performed by execution of instructions stored in a computer-readable medium by a processor.

A current pen is initially set to the first inkjet printer pen of a printer (302). The nozzles of the current pen are divided into sets of nozzles (304). A current nozzle set is then set to the first set of nozzles of the current pen of the printer (306), which are fired at a drop detect at a number of pen firing voltages, from a low voltage to a high voltage (308). The drop detect may be an electrostatic drop detect, such as the drop detect 104 of FIGS. 1 and 2.

The result of the nozzles of the current set being fired against the drop detect is a voltage-value curve (310). Where the drop detect is an electrostatic drop detect, this curve may be a pen firing voltage-electrostatic drop detect value, or score, curve. A representative such curve is shown in the graph 400 of FIG. 4. The graph 400 has an x-axis 402 that measures the applied pen firing voltage to the current set of nozzles, and a y-axis 404 that measures the value detected by the drop detect, such as the electrostatic drop detect value. The curve 406 is made up of a number of constituent discrete points 408A, 408B, . . . , 408I, corresponding to the voltages at which the current set of nozzles were fired. The number of points shown in curve 406 is greatly reduced from the actual number for purposes of illustrative clarity.

As can be seen from the graph 400, for the applied voltages at points 408A, 408B, 408C, and 408D, the drop detect registers low values, indicating that the inkjet pen nozzles of the current set have not substantially deposited ink on the drop detect. For the voltages at points 408G, 408H, and 408I, the drop detect registers high values, indicating that the inkjet pen nozzles of the current set have substantially deposited ink on the drop detect. The voltages at these points thus indicate that the voltages are greater than the turn-on voltage for the inkjet pen nozzles of the current set. Finally, for the points 408E and 408F, the drop detect registers interim values between the low values and the high values, indicating that the inkjet pen nozzles of the current set have not quite turned on completely, and have not deposited a full amount of ink on the drop detect.

Referring back to FIG. 3, once the voltage-value curve for the current set of nozzles has been obtained (310), the turn-on voltage for the current set of nozzles is determined (312). The turn-on voltage for the current set of nozzles is referred to as the nozzle turn-on voltage, to distinguish this turn-on voltage from the turn-on voltage for the current inkjet printer pen, which is the voltage necessary to turn on all the nozzles of the pen, and not just those of the current nozzle set. The nozzle turn-on voltage is generally determined based on the maximum slope of the curve that has been obtained. In one specific embodiment, the nozzle turn-on voltage can be obtained as shown in the method 312 of FIG. 5.

Figure 5:
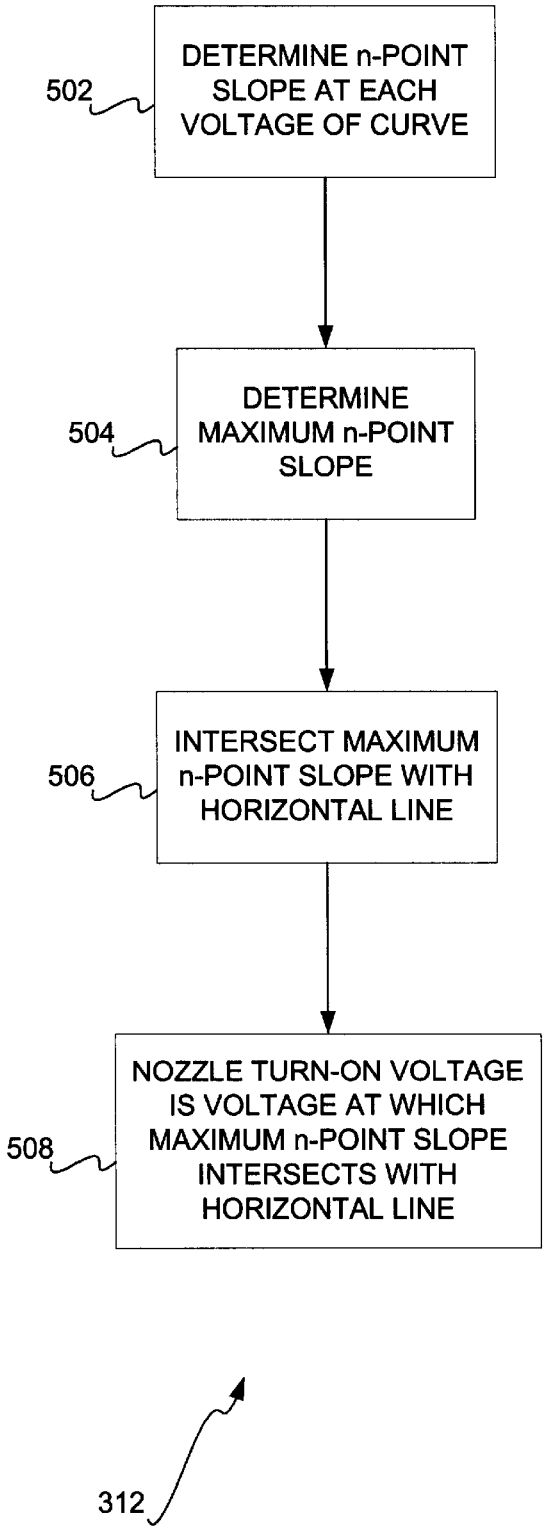
FIG. 5 is a flowchart of a method showing more specifically how one embodiment of the invention determines the nozzle turn-on voltage for a set of inkjet printer pen nozzles in the method of FIG. 3.

Referring to FIG. 5, an n-point slope is determined at each voltage of the curve (502). For example, the n-point slope can be determined at each constituent discrete point of the curve. In particular, a three-point slope can be determined, according to:

$$S_i = \frac{3(E_iV_i + E_{i+1}V_{i+1} + E_{i+2}V_{i+2}) - (E_i + E_{i+1} + E_{i+2})(V_i + V_{i+1} + V_{i+2})}{3(V_i^2 + V_{i+1}^2 + V_{i+2}^2) - (V_i + V_{i+1} + V_{i+2})^2}, \quad (1)$$

where $E_0, E_1, E_2, \ldots, E_n$ are the values, such as the electrostatic drop detect scores, associated with the voltages $V_0, V_1, V_2, \ldots, V_n$ at which the current nozzle set was fired. That is, the constituent discrete points of the curve are $(V_0, E_0), (V_1, E_1), (V_2, E_2), \ldots, (V_n, E_n)$. The n-point slopes are indicated by $S_i$, $i \epsilon 0,1,2, \ldots, n-2$. Although a three-point slope has been used in equation (1), more generally an n-point slope from an n-point line fit can be used. For instance, it may be desirable to use a different number of point slope instead, based on the resolution of the discrete pen firing voltage used in the printer.

The maximum n-point slope of the curve is then determined, or selected (504). The maximum n-point slope is the greatest slope of the slopes that were determined. This is the slope $$S_{max}=\max\{S_i, i\in 0,1,2,\ldots,n-2\}. \quad (2)$$

The point on the curve that has the maximum n-point slope is referred to as the maximum n-point slope point ($V_{max}$, $E_{max}$)

Next, the line tangent to the maximum n-point slope point, which corresponds to the maximum n-point slope, is intersected with a horizontal, zero-slope line (506). In one embodiment, the horizontal line can either be an upper horizontal line, or a lower horizontal line. The upper horizontal line is substantially parallel and corresponds to the values, or scores, of the voltage-value curve at which the current nozzle set has been turned on. Similarly, the lower horizontal line is substantially parallel and corresponds to the values, or scores, of the voltage-value curve at which the current nozzle set has been turned off. The upper horizontal line may be used for black ink, for instance, whereas the lower horizontal line may be used for color ink.

More specifically, the upper horizontal line can be determined by averaging the values or scores for the last k points of the voltage-value curve:

$$E_{high}=\frac{E_{n-k}+E_{n-k+1}+\ldots+E_n}{k}. \quad (3)$$

The line itself is therefore drawn as a zero-slope line at the value $E_{high}$. Similarly, the lower horizontal line can be determined by averaging the values or scores for the first k points of the voltage-value curve:

$$E_{low}=\frac{E_1+E_2+\ldots+E_k}{k}. \quad (4)$$

This line is therefore drawn as a zero-slope line at the value $E_{low}$

The nozzle turn-on voltage for the current nozzle set is then determined as the voltage at which the maximum n-point slope intersects with the horizontal line (508). That is, $$V_{ntov}=\frac{|E_{avg}-E_{\max}|+S_{\max}V_{\max}}{S_{\max}},\ E_{avg}\in E_{high}, E_{low}. \quad (5)$$

The voltage $V_{ntov}$ is the nozzle turn-on voltage for the current nozzle set, which corresponds to the voltage at which the maximum n-point slope intersects with either the upper horizontal or the lower horizontal line.

Figure 4:
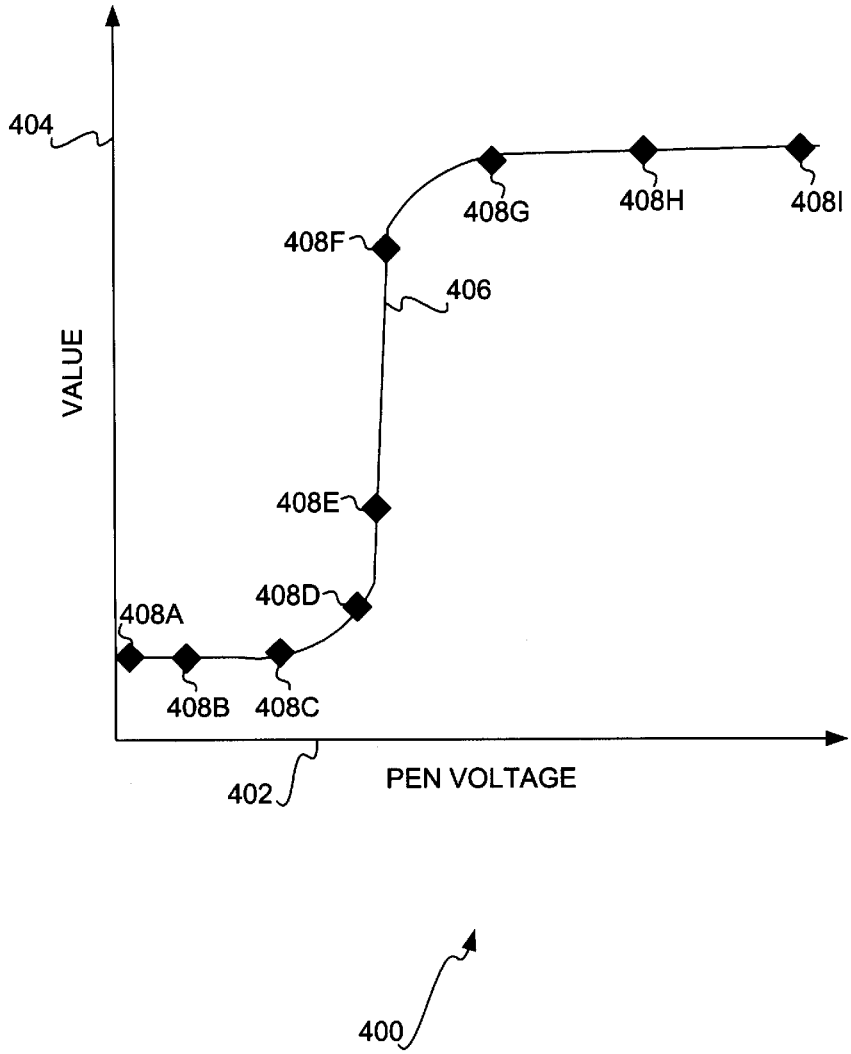
FIG. 4 is a graph of a representative voltage-value curve that results from the performance of the method of FIG. 3, according to an embodiment of the invention.
Figure 6:
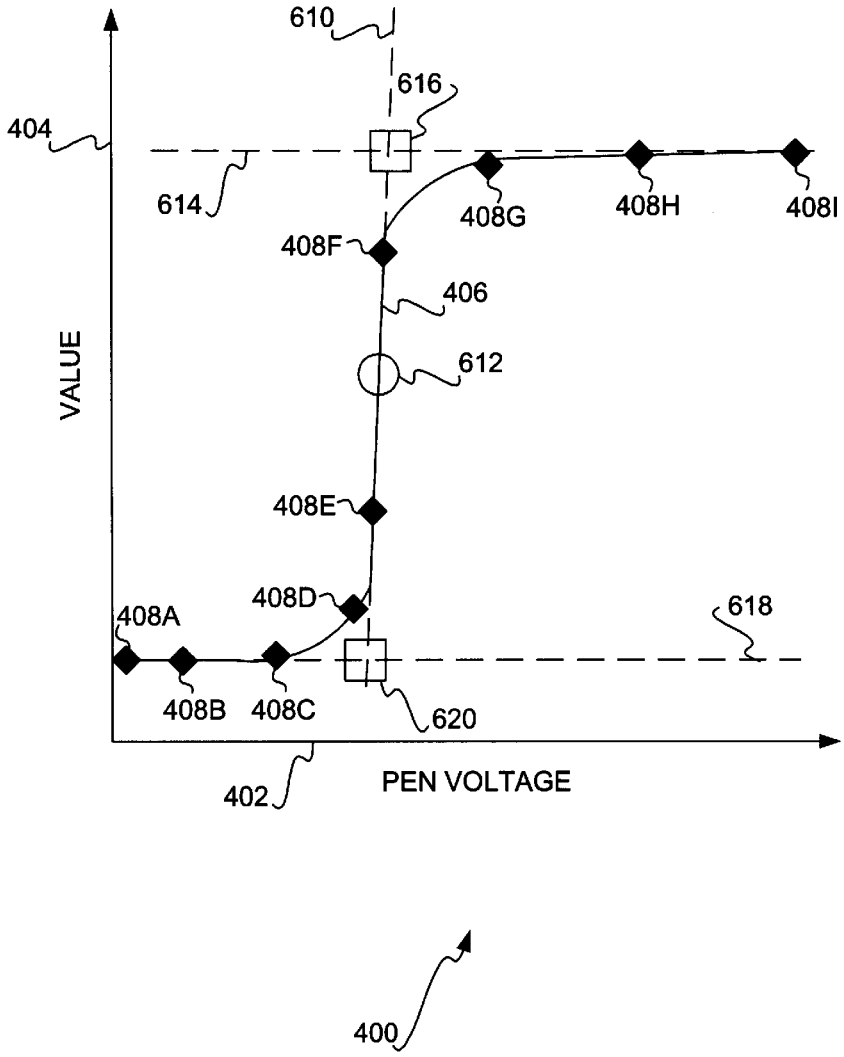
FIG. 6 is a graph of the representative voltage-value curve of FIG. 4 that more specifically results from the performance of the method of FIG. 5, according to an embodiment of the invention.

FIG. 6 shows the graph 400 of FIG. 4 in which the maximum n-point slope and the upper and lower horizontal lines have been added. The dotted line 610 corresponds to the maximum n-point slope, which is at the point 612. The dotted line 610 is tangent to the point 612. The upper horizontal dotted line 614 intersects with the dotted line 610 at the point 616, such that the voltage at the point 616 can be selected as the nozzle turn-on voltage for the current nozzle set, where the upper horizontal line is being used. The lower horizontal dotted line 618 intersects with the dotted line 610 at the point 620, such that alternatively the voltage at the point 620 can be selected as the nozzle turn-on voltage for the current nozzle set, where the lower horizontal line is being used.

Referring back to FIG. 3, once the nozzle turn-on voltage has been determined for the current set of nozzles (312), if there are more sets of nozzles to be fired at the drop detect (314), then the current set of nozzles is advanced to the next set of nozzles (316). The new current set is then fired (308) to obtain a voltage-value curve (310) from which another nozzle turn-on voltage is determined (312). Once all the sets of nozzles of the current pen have been fired at the drop detect (314), the turn-on voltage for the current pen is determined based on the nozzle turn-on voltages for the nozzle sets of the current pen (318). The nozzle turn-on voltages for the sets of nozzles of the current pen likely do not substantially vary from one another too much. The turn-on voltage for the current pen can be determined in a variety of different manners. For instance, either the median or the average value of the nozzle turn-on voltages may be used as the turn-on voltage for the current pen itself. As another example, the maximum nozzle turn-on voltage may be used as the turn-on voltage for the current pen.

The current pen's operating voltage is next optionally determined from the turn-on voltage for the current pen (320). The operating voltage may be determined by adding or multiplying an offset factor to the turn-on voltage for the pen. The operating voltage corresponds to the voltage at which the current pen is ultimately maintained during steady operation of the pen's nozzles. If there are more pens for which operating voltages need to be determined (322), then the current pen is advanced to the next pen (324), and the process that has been described is repeated for the new current pen. Once there are no more pens for which operating voltages need to be determined (322), the method 300 is done (326).

Conclusion

The invention provides for advantages within the prior art. In particular, the actual turn-on voltage for each inkjet printer pen is determined with the pens in the printer. This means that the turn-on voltages are precisely determined, given the manufacturing tolerances and environmental and other factors that may affect these voltages for specific pens as installed in specific printers. Furthermore, the turn-on voltages may be determined throughout the lives of the printer pens, to account for changes that may occur over time. The invention substantially decreases printing quality degradation and artifacts that result from overheating inkjet ink by applying voltages in excess of the actual turn-on voltages of the pens.

It is noted that, although specific embodiments have been illustrated and described herein, it will be appreciated by those of ordinary skill in the art that any arrangement is calculated to achieve the same purpose may be substituted for the specific embodiments shown. For example, other applications and uses of embodiments of the invention, besides those described herein, are amenable to at least some embodiments. This application is intended to cover any adaptations or variations of the present invention. Therefore, it is manifestly intended that this invention be limited only by the claims and equivalents thereof.

We claim:

1. A method for determining a turn-on voltage for an inkjet printer pen comprising:

for each set of nozzles of a plurality of sets of nozzles of the inkjet printer pen, firing the set of nozzles at each of a plurality of voltages to obtain a voltage-value curve for the set of nozzles;

determining a nozzle turn-on voltage for the set of nozzles based on the voltage-value curve for the set of nozzles, the nozzle turn-on voltage being less than an upper plateau voltage of the voltage-value curve; and, determining the turn-on voltage for the inkjet printer pen based on the nozzle turn-on voltage of the voltage-value curve for each set of nozzles, by selecting a maximum nozzle turn-on voltage of the nozzle turn-on voltages of the voltage-value curves for the sets of nozzles as the turn-on voltage for the inkjet printer pen.

2. The method of claim 1, further initially comprising dividing a plurality of nozzles of the inkjet printer pen into the plurality of sets of nozzles.

3. The method of claim 1, further comprising determining a pen operating voltage as the turn-on voltage for the inkjet printer pen plus a predetermined offset voltage.

4. The method of claim 1, further comprising repeating the method for each of a plurality of inkjet printer pens other than the inkjet printer pen for which the method has already been performed.

5. The method of claim 1, wherein firing the set of nozzles at each of the plurality of voltages comprises firing the set of nozzles as aimed at an electrostatic drop detect of the inkjet printer, such that the voltage-value curve for the set of nozzles comprises a voltage-electrostatic drop value curve.

6. The method of claim 1, wherein determining the nozzle turn-on voltage for the set of nozzles based on the voltage-value curve for the set of nozzles comprises determining the nozzle turn-on voltage for the set of nozzles based on a maximum slope of the voltage-value curve.

7. The method of claim 1, wherein determining the turn-on voltage for the inkjet printer pen based on the nozzle turn-on voltage of the voltage-value curve for each set of nozzles comprises using one of an average and a median of the nozzle turn-on voltages of the voltage-value curves for the sets of nozzles as the turn-on voltage for the inkjet printer pen.

8. A computer-readable medium having instructions stored thereon for execution by a processor to determine a turn-on voltage for each inkjet printer pen of a plurality of inkjet printer pens comprising, for each inkjet printer pen of the plurality of inkjet printer pens, by performing a method comprising:

for each set of nozzles of a plurality of sets of nozzles of the inkjet printer pen, firing the set of nozzles at each of a plurality of voltages to obtain a voltage-value curve for the set of nozzles;

determining an n-point slope for each of the plurality of voltages of the voltage-value curve;

determining a maximum n-point slope line of the n-point slopes for the plurality of voltages;

intersecting the maximum n-point slope line with a horizontal line, such that a nozzle turn-on voltage for the set of nozzles corresponds to a voltage at which the maximum n-point slope intersects with the horizontal line and that is less than an upper plateau voltage of the voltage-value curve; and, determining the turn-on voltage for the inkjet printer pen based on the nozzle turn-on voltage of the voltage-value curve for each set of nozzles of the inkjet printer pen.

9. The medium of claim 8, wherein firing the set of nozzles at each of the plurality of voltages comprises firing the set of nozzles as aimed at an electrostatic drop detect of an inkjet printer, such that the voltage-value curve for the set of nozzles comprises a voltage-electrostatic drop value curve.

10. The medium of claim 8, wherein determining the n-point slope for each of the plurality of voltages of the voltage-value curve comprises using n-point line interpolation.

11. The medium of claim 8, wherein intersecting the maximum n-point slope line with the horizontal line comprises intersecting the maximum n-point slope line with one of a lower horizontal line and an upper horizontal line.

12. The medium of claim 8, wherein the processor is to perform the instructions when an inkjet cartridge including the plurality of inkjet printer pens is first installed in an inkjet printer.

13. The medium of claim 8, wherein the processor is to perform the instructions periodically over an operating life of an inkjet cartridge including the plurality of inkjet printer pens.

14. The medium of claim 8, wherein the medium and the processor are part of an inkjet printer having the plurality of inkjet printer pens.

15. An inkjet printer comprising:

a plurality of inkjet printer pens, each inkjet printer pen having a turn-on voltage and a plurality of nozzles divided into a plurality of sets of nozzles;

a drop detect at which the plurality of nozzles of each inkjet printer pen can be aimed; and, firmware to determine the turn-on voltage of each inkjet printer pen by firing each set of nozzles of the inkjet printer pen at each of a plurality of voltages, aiming at the drop detect, to obtain a voltage-drop value curve for each set of nozzles, and determining a nozzle turn-on voltage for each set of nozzles based on the voltage-drop value curve for the set of nozzles, the nozzle turn-on voltage determined as less than an upper plateau voltage of the voltage-drop value curve for the set of nozzles, wherein the turn-on voltage for each inkjet printer pen is based on the nozzle turn-on voltage of the voltage-drop value curve for each set of nozzles of the inkjet printer pen, by selecting a maximum nozzle turn-on voltage of the nozzle turn-on voltages of the voltage-value curves for the sets of nozzles as the turn-on voltage for the inkjet printer pen.

16. The printer of claim 15, wherein the drop detect comprises an electrostatic drop detect.

17. The printer of claim 15, wherein the inkjet printer further comprises a processor, and the firmware comprises a computer-readable medium having instructions stored thereon for execution by the processor.

18. The printer of claim 15, wherein the plurality of inkjet printer pens includes a black pen and a plurality of color pens.

19. The printer of claim 18, wherein the plurality of color pens includes a cyan color pen, a magenta color pen, and a yellow color pen.

* * * * *